United States Patent [19]

Cioni et al.

[11] 3,939,626

[45] Feb. 24, 1976

[54] MACHINE FOR AUTOMATIC FILLING AND SEALING OF GLASS VIALS

[76] Inventors: Elisabetta Cioni; Lucia Cioni; Rovena Anichini Cioni, all of Via di Marciano 22, Siena, Italy, I-53100

[22] Filed: Aug. 16, 1974

[21] Appl. No.: 498,043

[30] Foreign Application Priority Data

Aug. 21, 1973 Italy ..... 9594/73

[52] U.S. Cl. ..... 53/167; 53/266 R; 53/381 R

[51] Int. Cl.[2] ..... B65B 7/16

[58] Field of Search ..... 53/167, 266, 381 R

[56] References Cited

UNITED STATES PATENTS

| | | | |
|---|---|---|---|
| 2,530,230 | 11/1950 | Cozzoli | 53/266 X |
| 2,689,677 | 9/1954 | Unger | 53/266 |
| 2,749,688 | 6/1956 | Cozzoli | 53/266 X |
| 2,838,893 | 6/1958 | Sickel | 53/167 X |
| 2,908,124 | 10/1959 | Hagen | 53/266 X |

*Primary Examiner*—Donald R. Schran
*Assistant Examiner*—Leon Gilden
*Attorney, Agent, or Firm*—McGlew and Tuttle

[57] ABSTRACT

The machine includes an endless conveyor having receptacles for holding the vials and the conveyor can be indexed through a multiple number of pitches of the receptacles. Needles and syringes are provided for filling the vials held on the conveyor and, downstream of the needles, there are provided burners and pinch devices which serve to seal the filled vials while they are being rotated by pairs of friction wheels.

8 Claims, 28 Drawing Figures

F
Fig.1
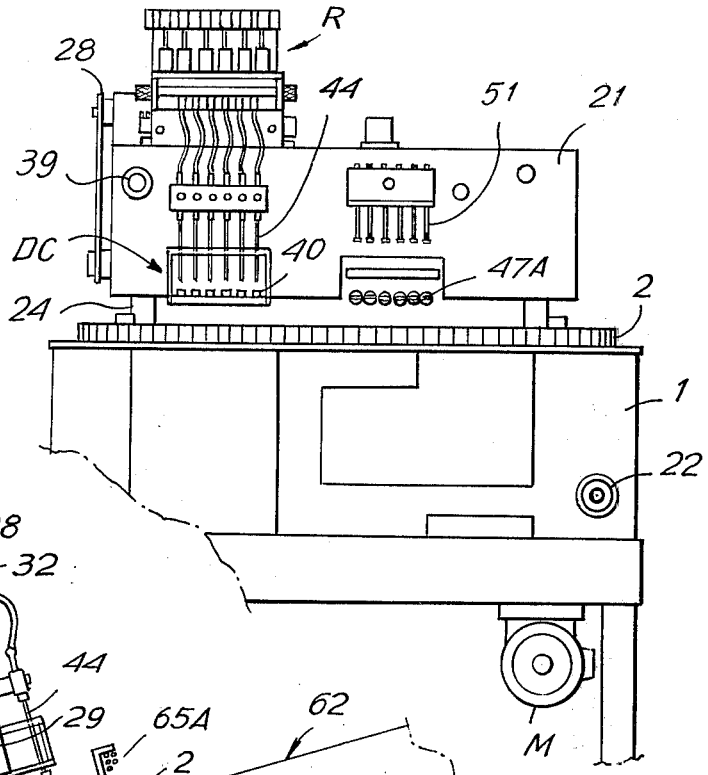
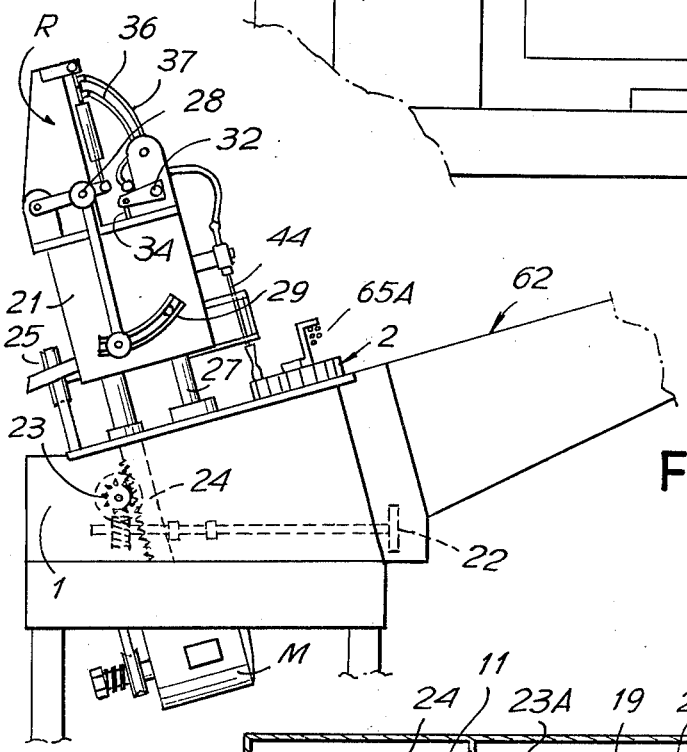
Fig.2
Fig.3
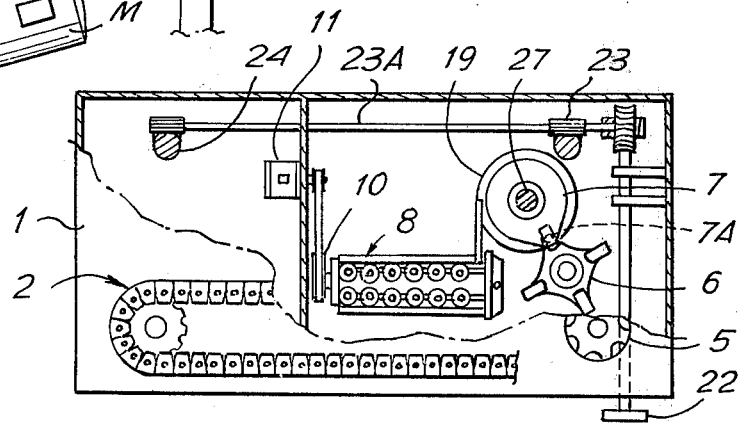

F

F

F

F
Fig.10
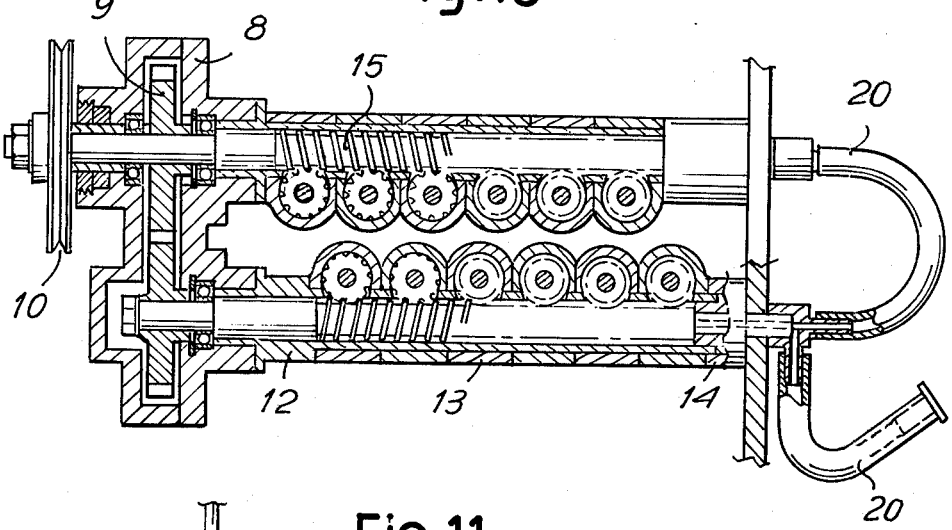
Fig.11
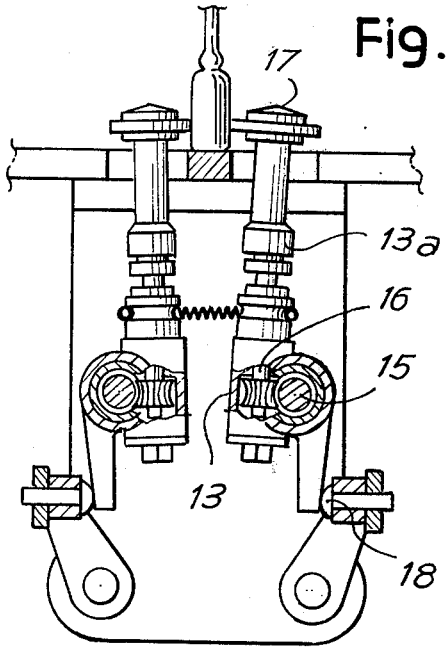
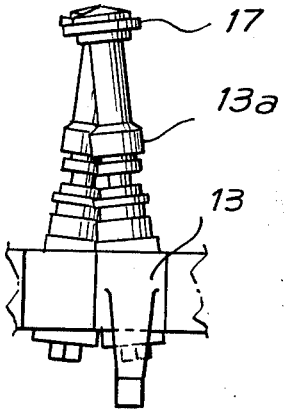
Fig.12

F
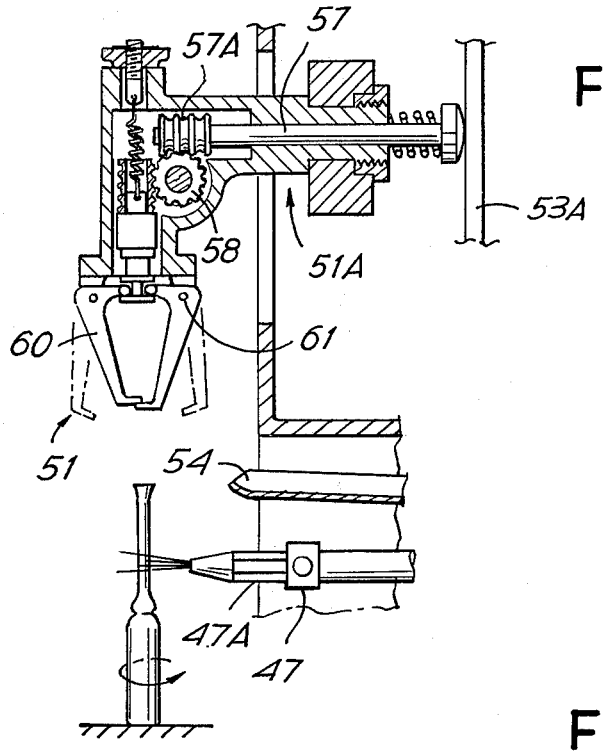
Fig. 13
Fig. 14
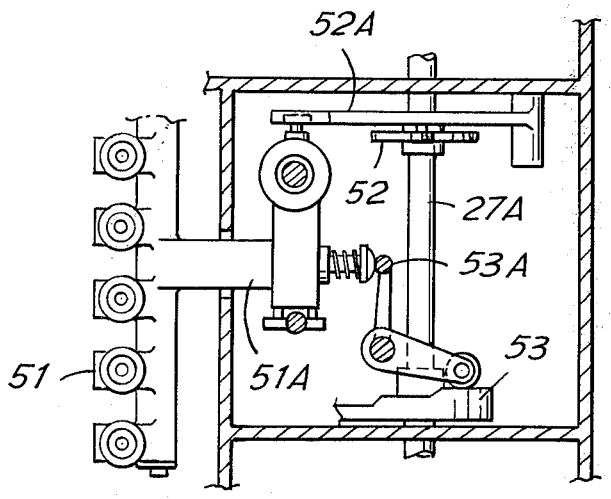

F
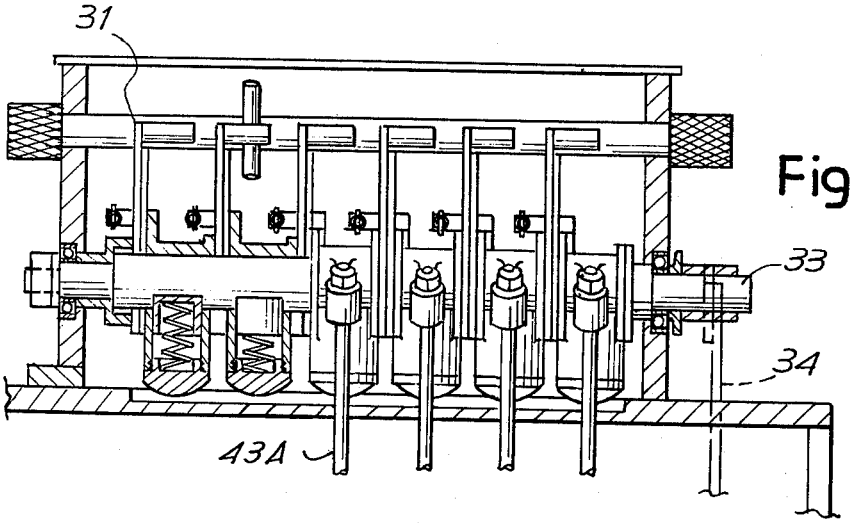
Fig.15
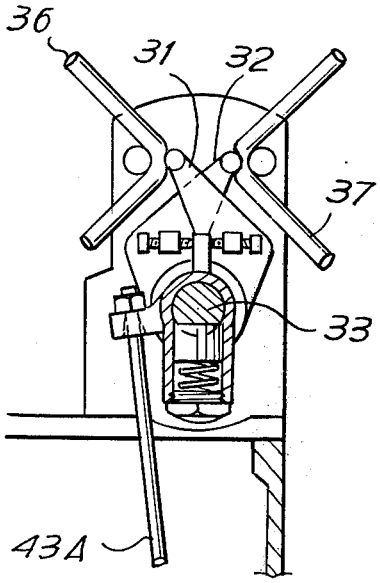
Fig.16
Fig.17
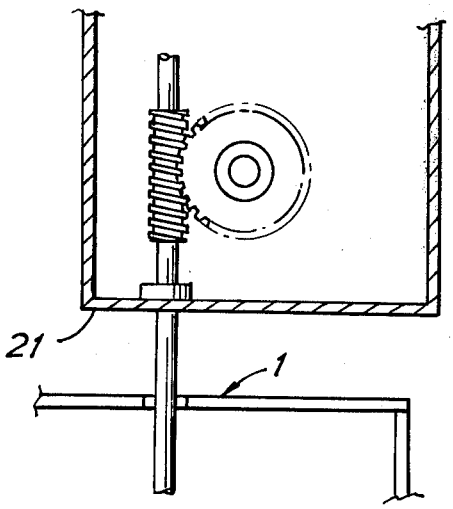

F
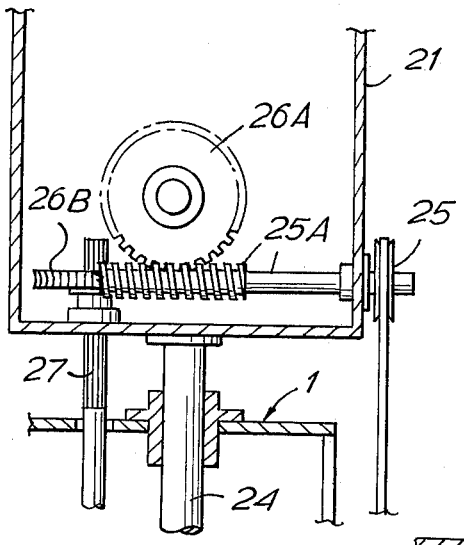
Fig.18
Fig.19
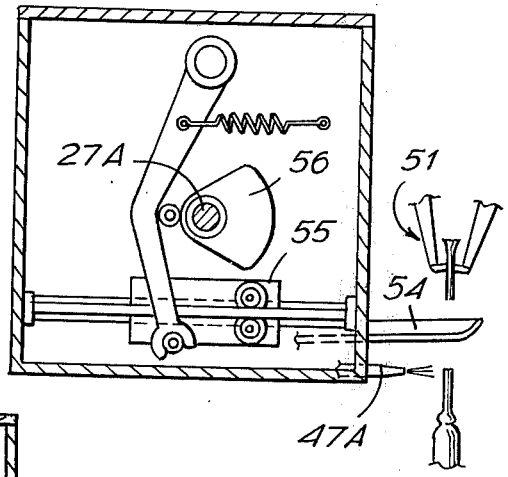
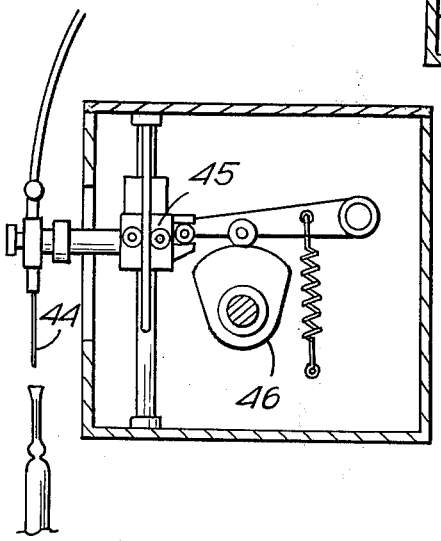
Fig.20

F
Fig.21
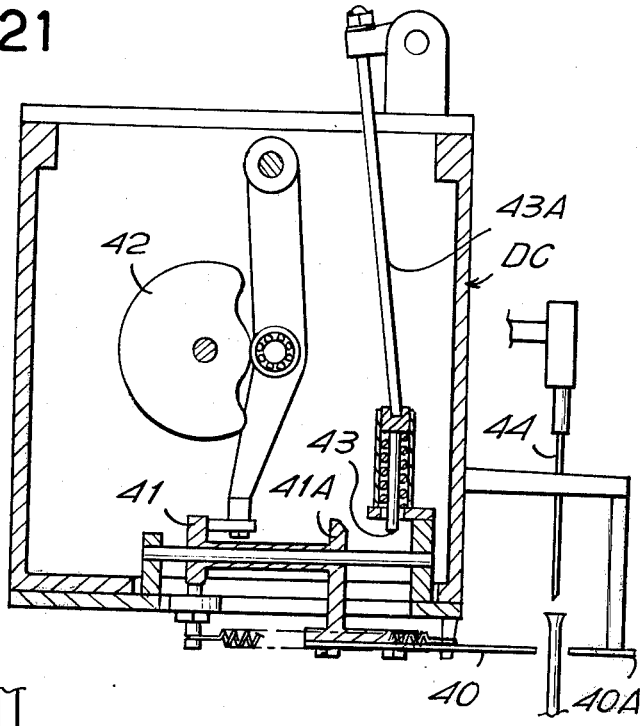
Fig.22
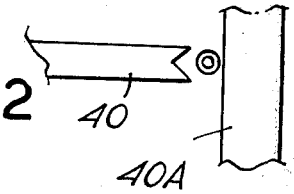
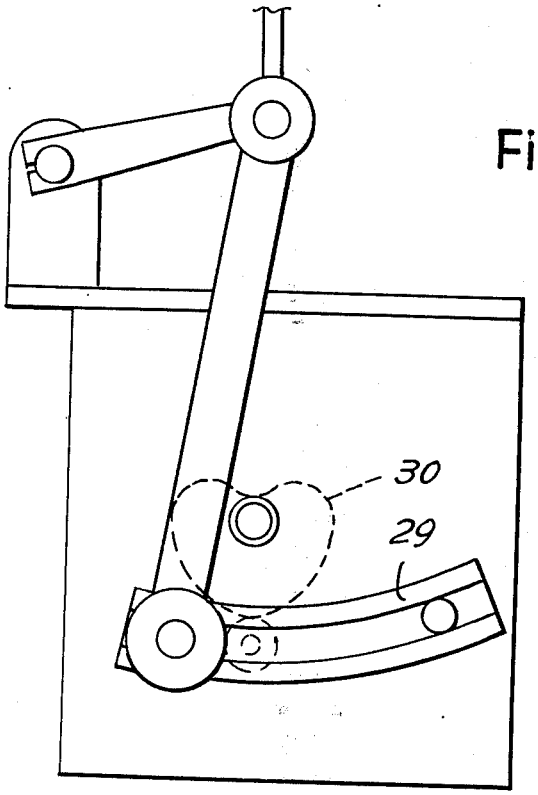
Fig.23

F
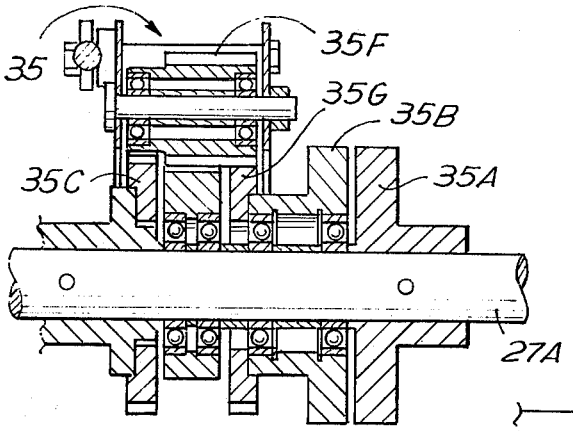
Fig.24
Fig.25
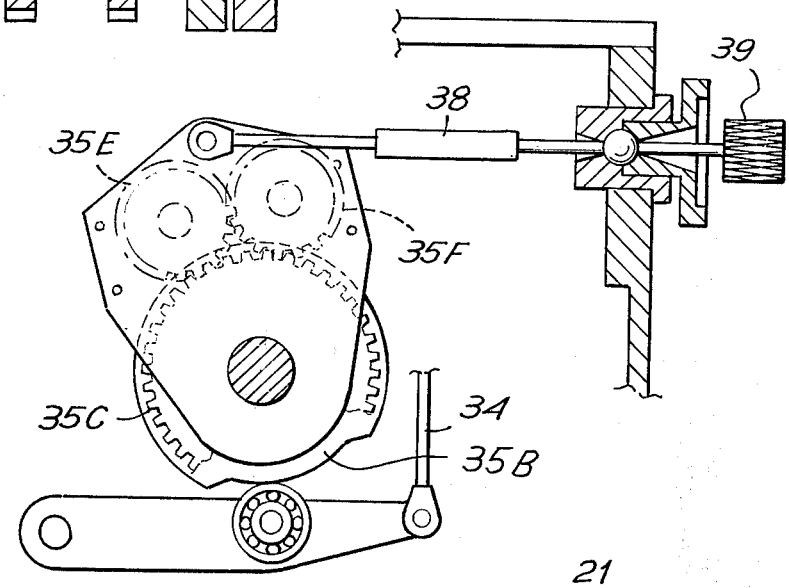
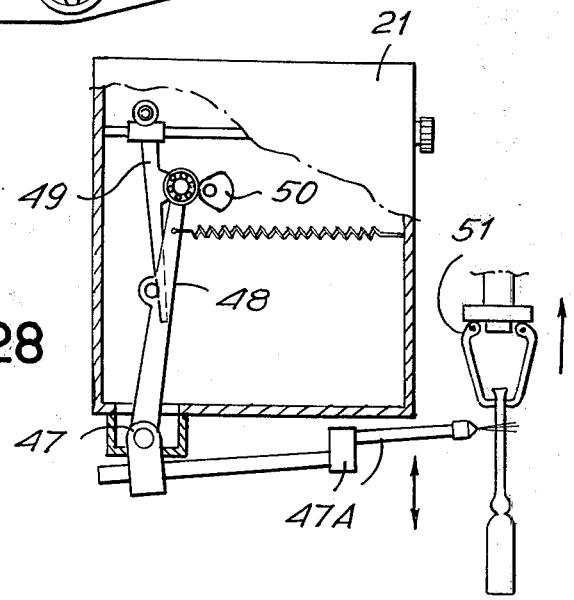
Fig.28

MACHINE FOR AUTOMATIC FILLING AND SEALING OF GLASS VIALS

BACKGROUND OF THE INVENTION

This invention relates to a machine for automatic filling and sealing of glass vials.

SUMMARY OF THE INVENTION

According to the present invention there are provided, in a machine for filling and sealing glass vials, endless conveyor means comprising a plurality of receptacles for the vials so arranged that the vials are accommodated in an upright position, and means for indexing the conveyor means through a multiple number of pitches of the receptacles, means for feeding to the conveyor means a plurality of vials simultaneously, means for filling the vials with a liquid, comprising a plurality of syringes and a plurality of needles communicating with the syringes, sealing means comprising a plurality of burners and a plurality of pinch means, the burners and pinch means being disposed at contiguous sealing stations along the length of the conveyor means whereby a plurality of vials can be sealed simultaneously, and means to rotate the vials during the sealing operations, the rotating means comprising pairs of friction wheels and means for moving the wheels of each pair towards and away from one another, and drive means of the machine including control cams for the individual said means.

The machine may in practice include a lower casing with the endless conveyor means, the vial rotating means and the vial supply and discharge means and a structure overlying the lower casing and adjustable in its height, with control means for the filling and sealing and drive means with members contained in the lower casing. At a multiple station upstream of the filling stations a plurality of movable needles, may be provided which are similar to the filling needles, for supplying an inert gas for washing the insides of the vials, so as to avoid the presence of a chemically active atmosphere in the vials during the filling stage.

BRIEF DESCRIPTION OF THE DRAWINGS

One embodiment and a modification of a machine for filling and sealing glass vials will now be described, by way of example, with reference to the accompanying diagrammatic drawings, in which:

FIG. 1 is a front view of the machine;

FIGS. 2 and 3 are respectively a side view and a plan view, partially in section, of the machine of FIG. 1;

FIGS. 10, 11 and 12 show a device for the rotation of the vials at a sealing stage respectively in horizontal section, in vertical cross-section and in fragmentary side view;

FIGS. 13 and 14 show sections of a pinch device of the machine for the removal of the necks of vials at the sealing station;

FIGS. 15 and 16 show sections of intake and delivery valves communicating with filling needles of the machine;

FIG. 17 shows a detail of a drive system interconnecting mechanisms of the lower and upper casings of the machine;

FIG. 18 shows a further detail of the drive system of FIG. 17;

FIG. 19 shows operational members of a collection tray for the vial necks removed at the sealing station;

FIGS. 20, 21 and 22 illustrate a drive mechanism of filling needles and of the vial centering means at a filling station of the machine;

FIG. 23 illustrates control means of the filling needles;

FIGS. 24 and 25 are respectively an axial and cross-section of a pair of cams with the means for the adjustment thereof for the control of plungers of the needles, these plungers serving to cause a brief intake by the needles at the end of the delivery stroke;

FIG. 28 is a cross-section on line XXVIII—XXVIII of FIG. 9.

DESCRIPTION OF THE PREFERRED EMBODIMENT

Figure 4:
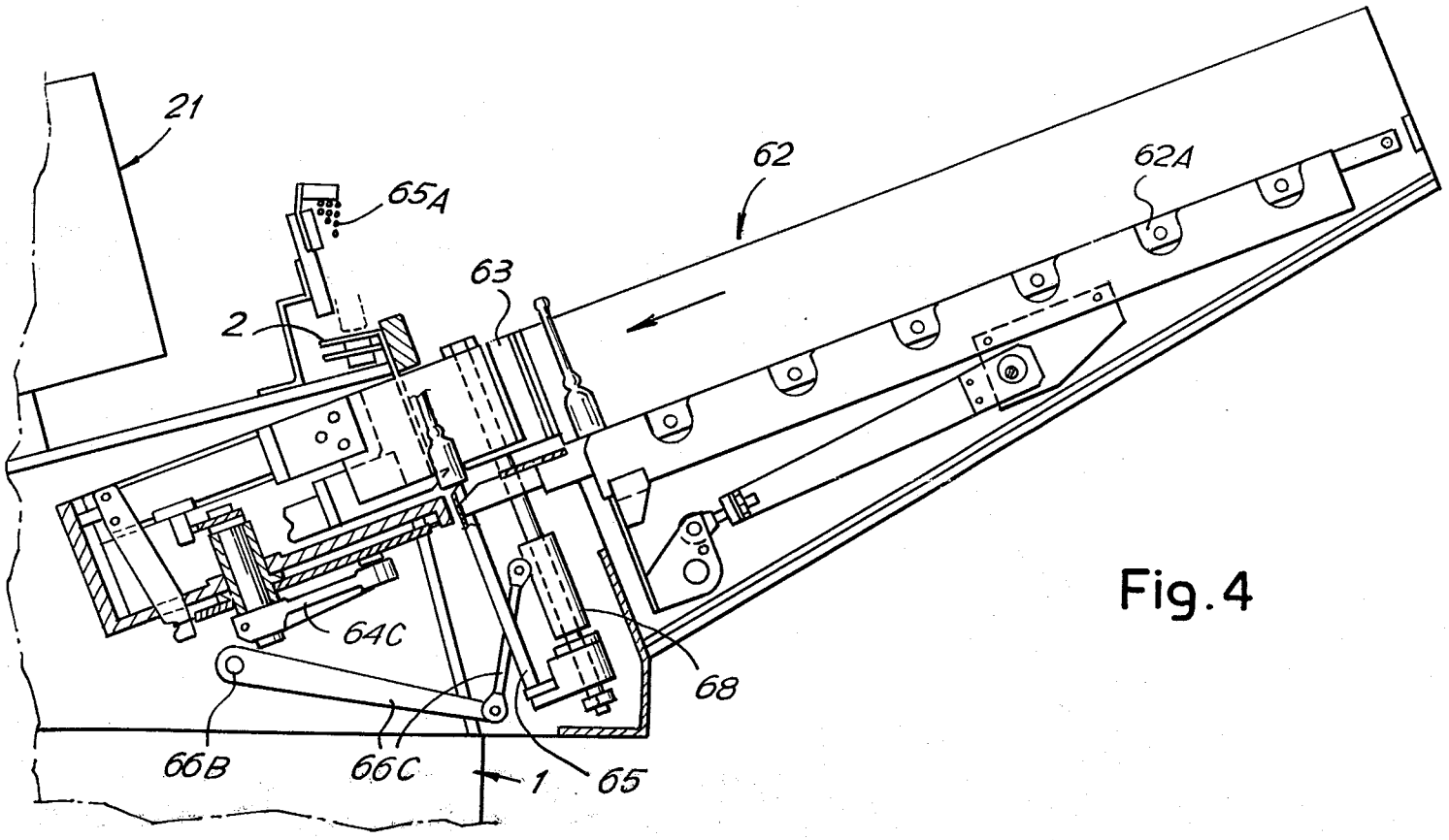
FIGS. 4 and 5 show respectively a loading unit of the machine in longitudinal, vertical section and in plan view.

A stationary casing 1 carries an endless conveyor 2 built up from containers or other receptacles 3 for the vials secured to an inextensible belt 4 with gear-like teeth. The conveyor is driven by a wheel 5 actuated by a maltese cross type tripping feed device, which includes the maltese cross unit 6 and a continuous motion wheel 7 provided with a pin 7A which is inserted in the recesses of the maltese cross device. The maltese cross device drives the wheel 5 so that the conveyor 2 is indexed every time by a length equal to six interspaces between the receptacles 3, that is a length equal to six pitches between the receptacles.

A device for rotating the vials is provided at a sealing station. This device includes a box 8 (FIG. 3) with a pair of gears 9 driven by a pulley 10 in turn driven by an independent small electric motor 11. Two oscillatory units are carried on the box 8 each formed by members 12, 13, 14 (FIGS. 10, 11, 12) constituting hollow shafts capable of angular movements about the axis of the gear wheels 9. Geared shafts (or worm-shafts) 15 which extend within the members 12, 13, 14 are integral with the gear wheels 9. The members 13 (six in each of the oscillatory units) are each provided with an upwardly-extending extension **13*a*, in which the shafts 16 are housed, which carry external friction rollers 17. The extensions 13*a* are inclined with respect of one another so that the diameters are substantially aligned but the shafts 16 are relatively inclined to one another. The shafts 16 terminate at skew gear wheels and are driven by the worm shafts 15 fast with the gear wheels 9. The inclined arrangement of the rollers 17 is such that, when the vial in the sealing position is pressed by the two rollers, the latter, besides imposing the required rotation, tend to retain the vial on the conveyor 2. The two units are simultaneously moved to separate or bring together the rollers 17 by means of tappets 18 actuated by the cam 19 (FIG. 3). The two units are lubricated in a closed cycle from the reservoirs 20.**

Above the casing 1, an upper casing 21 is mounted, which is adjustable for height by means of a handwheel 22, a gear wheel 23, a shaft 23A and racks 24 mounted in casing 1.

A motor M, fixed to the lower casing 1, actuates through a belt a pulley 25, mounted on a worm shaft 25A (FIG. 18). This shaft 25A simultaneously drives a worm wheel 26A and, a worm wheel 26B which, by means of a splined shaft 27, transmits power to various parts of the machine, including the cam 19, (FIG. 3).

Figure 9:
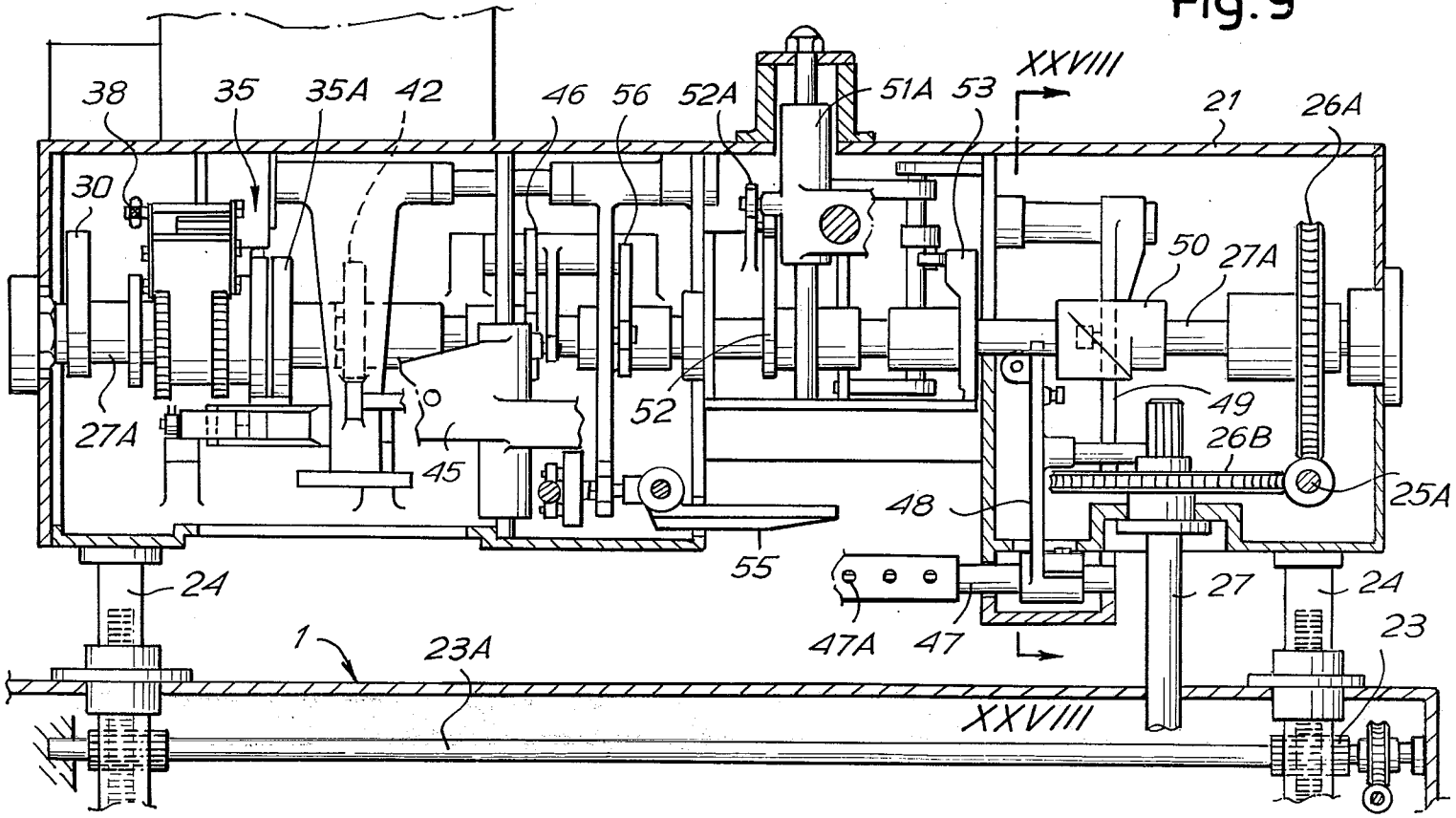
FIG. 9 is a vertical section showing control members contained in a movable casing overlying a lower casing of the machine.

A filling device R includes a stirrup carrying a group of syringes to which the liquid delivery tubes to the needles are fixed. Reciprocating motion is imparted to the syringes by a group of levers 28 (FIG. 2) controlled by a sector member 29 (FIG. 23) which allows the lever 28 to slide along a channel thereof, so as to adjust the stroke of the plungers of the syringes S by means of a stop movable along the arcuate track of the sector member. The whole mechanism is driven by a cam 30 (FIG. 9), carried by the main shaft 27 journalled in the casing 21.

The flow of the liquid from the syringes to the vials is adjustable by a valve system. This system includes oscillatory levers 31 and 32 (FIG. 16) resiliently mounted on a shaft 33 which is driven by a lever 34 from an adjustable cam unit 35, (FIGS. 24 and 25). The oscillating levers 31 close a flexible intake tube 36 when the plungers of the syringes S rise upwardly and then inject the liquid into the vials. Subsequently, when the plungers return and the intake begins, the lever 32 closes a flexible delivery tube 37 and the lever 31 immediately opens the intake tube 36. It is essential that often one must have a small intake from the liquid delivery tubes to the needles, so as to avoid the dripping of the liquid remaining in the tubes. For this purpose, two cams are provided, the profile of which is variable by translation of one of them relative to the other. One cam 35A is fixed too the shaft 27A and the other cam 35B is free on the drive shaft 27A and is adjustable by mechanism including a gear 35C fixed on the main shaft 27A and meshing with a pinion 35E which in turn moves a pinion 35F meshing with a gear 35G secured to the cam 35B. This mechanism allows the cam 35B to be displaced with respect to the other cam 35A, so as to obtain different profiles even with the machine in motion, by means of a knob 39 fixed to a rod 38, secured in turn to a part of the above described mechanism.

It may occur that a vial is not presented at the filling needles, and it is essential that, if so, the liquid should not be injected. A centering device DC is therefore provided. When six vials are located at the filling station six feelers 40 (FIGS. 1, 21 and 22) fixed to corresponding slides 41, independent of one another, retractable by a cam 42 and arranged to be advanced by biasing springs, serve to center the vials with respect to the filling needles, in cooperation with a bar 40A. If one of the feelers 40 does not contact its corresponding vial, it advances further in relation to the other thereby actuating, with a corresponding linear cam 41A, a tappet 43 which, with the aid of a rod 43A, closes the delivery valve 32 and opens the intake valve 31 so that the liquid returns to its reservoir (not shown) independently of the liquid flow control operated by the shaft 33.

The product is injected into the vials by means of the six needles 44 mounted on a slide 45 (FIG. 20) guided for substantially vertical movement and operated by a cam 46 of the shaft 27A (FIG. 9), so as to lower the needles whenever a batch of vials is located at the filling station.

The closure of the necks of the vials is effected by six gas burners 47A (FIGS. 19 and 28) operable continuously and which are lowered towards the vials to the sealing points of the vials when the latter are stationary. The burners are fixed to a pivotal support 47 operated by levers 48, 49 and by a variable length profile cam 50. This cam 50 enables the sealing time to be varied by moving the lever 49 along its profile, while by rotating the lever 48 on its own pivot axis, the sealing point height is varied.

During the sealing the vials are rotated by the above described device, while six pincers 51 which are open and carried by a vertical slide 51A (FIG. 9), are lowered by a cam 52 and by an arm 52A, to arrive in proximity to the sealing point. Subsequently the pincers are closed by a cam 53, this action causing the necks to be engaged above the sealing point, and then rise upwardly, thereby tearing the necks at the point where they have been fused by the burners. Immediately thereafter a plate 54 (FIG. 19) fixed to a slide 55 and operated by a cam 56, advances below the pincers. The latter, after retraction upwardly are opened and drop the severed neck portions on the plate 54. These neck portions will fall into an appropriate container located behind the machine. Simultaneously the gas burners 47A are moved away from the vials.

The opening of the pincers is effected by a rod 57 (FIG. 13) actuated by a tappet 53A of a cam 53 and carrying at one end a worm 57A which meshes with a worm wheel 58 which extends the entire length of the body of the pincers and which in turn meshes with a gear 59, one for each pincer, which actuates the arms 60 of the pincers 51 pivoted at 61.

Figure 5:
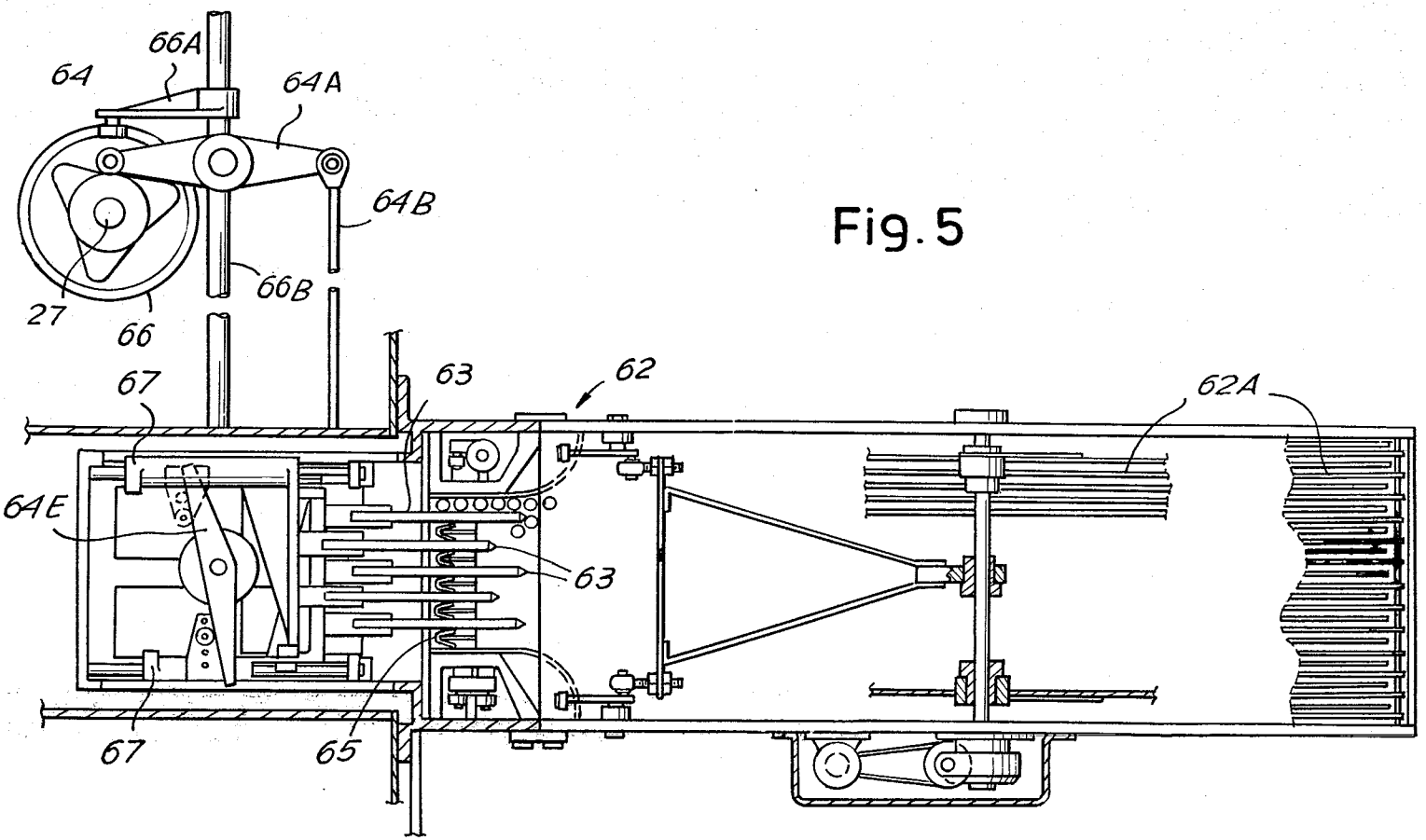

The vials are fed to the machine by a loading device 62 (FIGS. 4 and 5) having a double inclined plane grid 62A and with the bars of a fixed grid and those of the other grid movable similarly to a so-called "pilgrim pace". At the lower end of the grid 62A the vials are distributed by blades 63 arranged in two groups having a reciprocating unphased motion, as they are secured to slides 67 driven by a cam 64, through a linkage 64A, 64B, 64C and 64E.

The loading of the conveyor is effected by expelling units 65, secured to a slide 68 actuated by a cam 66, through an arm 66A, a shaft 66B and a linkage 66C. The expelling units 65 urge the vials onto the top of the respective containers or receptacles 3 of the conveyor, when they reach the loading position. The vials then drop down into the containers, the ends of the expelling rods being chamfered to prevent the overturning of the vials outwardly. Small chains 65A, located above the conveyor 1, prevent the vials from being moved horizontally when they drop into the containers 3.

Figure 6:
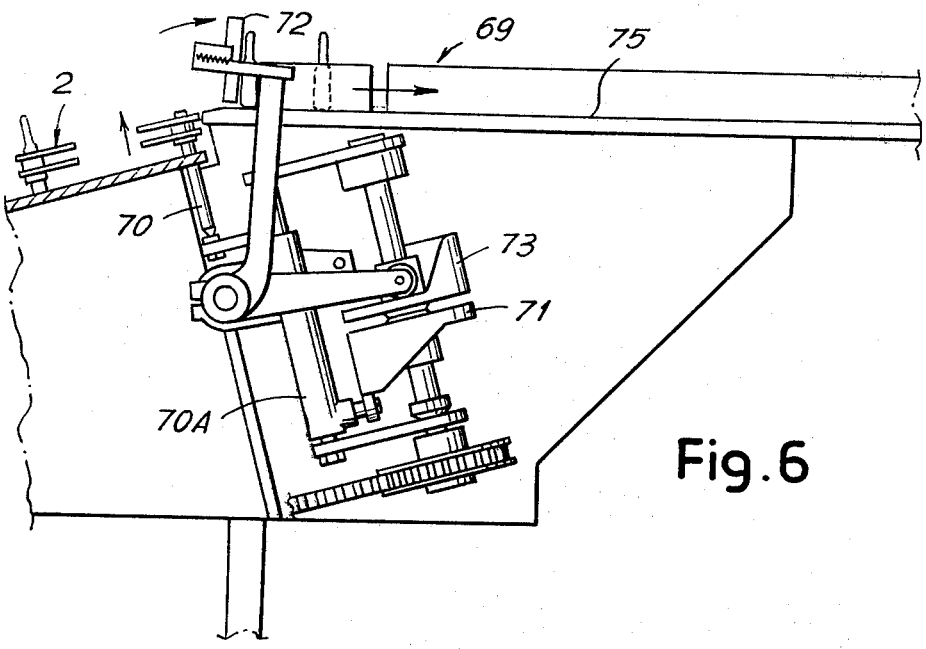
FIG. 6 is a vertical section of a detail of a discharge mechanism of the machine.
Figure 7:
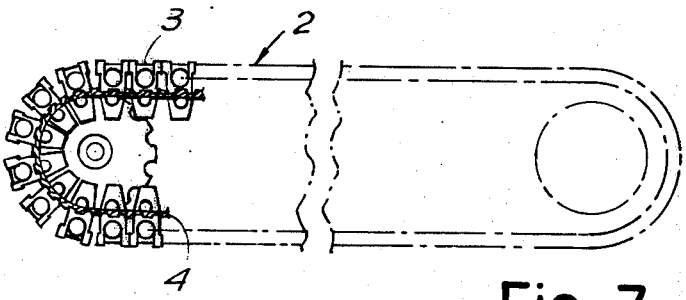
FIGS. 7 and 8 are respectively a plan view of an endless conveying means and a cross-section, of one of the drive pinions of the conveying means.
Figure 8:
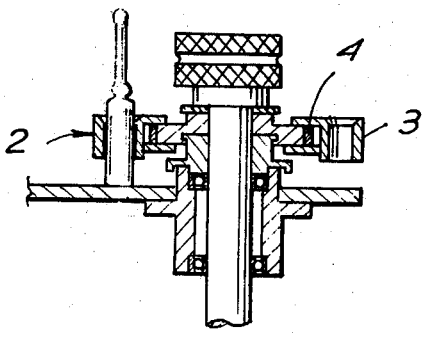

A discharge device 69 (FIG. 6) for discharging the vials from the conveyor includes expelling devices 70 secured to a slide 70A actuated by a cam 71. A plate 72, actuated by a cam 73 through oscillatory arms 73A, serves to collect the vials and place them on a discharge plane 75 and to translate them laterally after raising by the expelling units 70.

Figure 26:
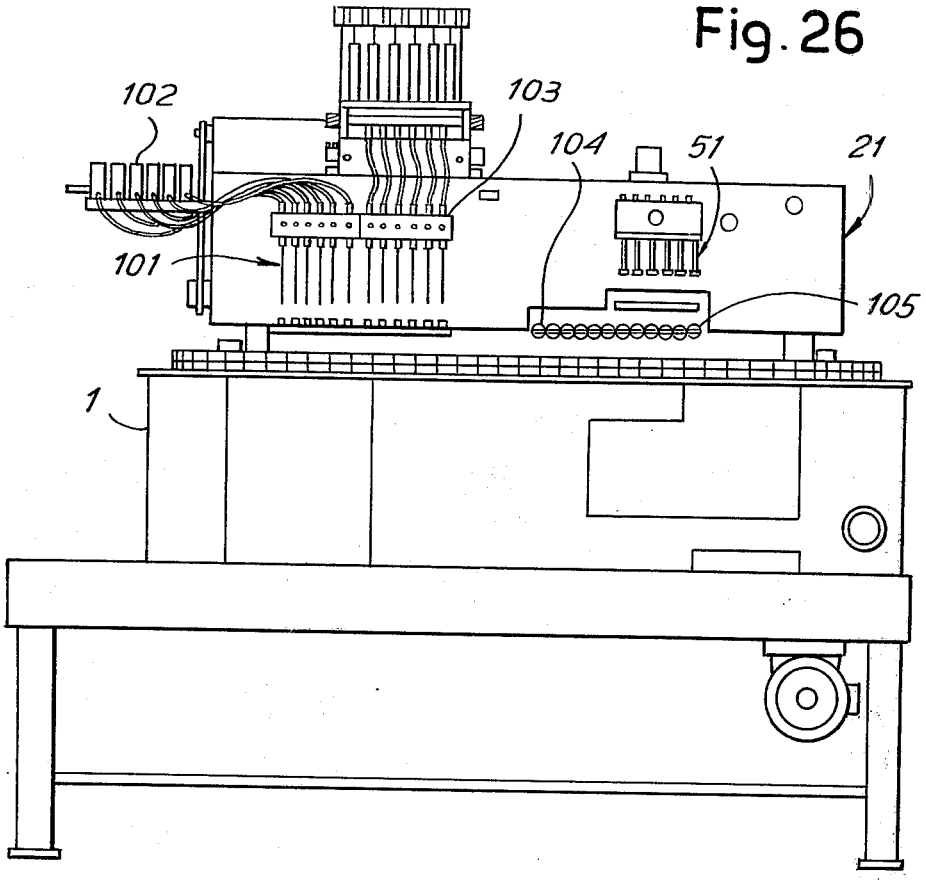
FIGS. 26 and 27 are respectively a lateral view and a plan view, partially in section, of a modified machine, which provides for scavenging the interior of the vials with an inert gas.
Figure 27:
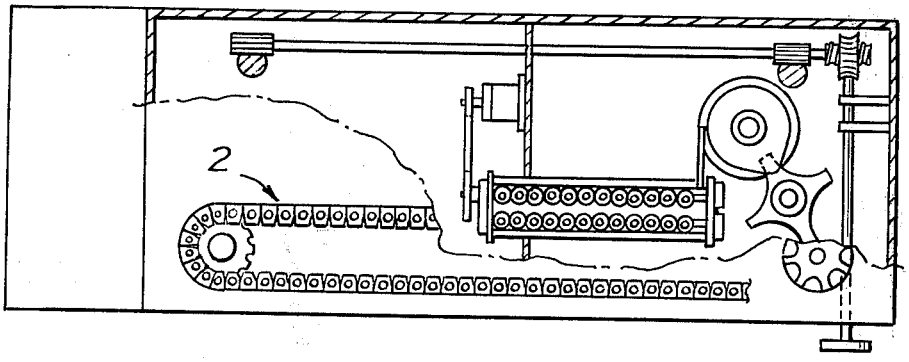

The machine may be modified as shown in FIGS. 26 and 27 to fill the vials under an inert gas. Twelve needles are provided, of which the first six, 101, serve for the injection of the inert gas, for instance, nitrogen, into the vials, so as to create in the vials an atmosphere, which does not give rise to any chemical reaction when contacting the product. The gas flow can be adjusted with the aid of flowmeters 102. The other six needles 103, actuated by the same lever as the cam needles 101, serve to inject the product. The machine comprises twelve sealing tips, of which the first six indicated at 104 are intended for the pre-heating of the necks of the vials. By this means, excessive heating by the other six burners 105 which effect the sealing and which could burn the glass is avoided. At the stations at which the twelve burners 105 are located, a 12-position rotational device is provided for the vials which is similar to the one already described in relation to the main embodiment.

The machine is intended to achieve a high production rate, the filling and the sealing and every other operation being simultaneously effected for a number of vials.

We claim:

1. A machine for filling and sealing glass vials comprising, in combination, a frame having an upper support surface; endless conveyor means operable to receive the vials and to move the vials along said support surface; said endless conveyor means comprising an endless gear belt having secured thereto, in adjacent relation, a plurality of receptacles adapted to have the vials inserted thereinto from above for resting on said support surface, said receptacles maintaining the vials in an upright orientation during travel of the vials along said support surface; indexing means operatively connected to said conveyor means and operable to step said endless belt and said receptacles, cyclically and repetitively, so a distance equal to the length of said endless belt spanned by a plurality of said vials; feeding means positioned at a feeding station adjacent said conveyor means and operable, cyclically and repetitively, to feed, into said receptacles, a plurality of vials simultaneously, the plurality of vials being equal to the number of vials in said length span; filling means positioned adjacent said conveyor means downstream of said feeding means in the direction of movement of said endless belt, for filling the vials with a liquid; said filling means comprising a plurality of syringes equal in number to said plurality of vials fed simultaneously by said feeding means and a plurality of needles, equal in number to said plurality of syringes, each communicating with a respective syringe; sealing means positioned adjacent said conveyor means downstream from said filling means in the direction of movement of said endless belt; said sealing means comprising a plurality of burners equal in number to the number of vials fed simultaneously to said receptacles by said feeding means, and a plurality of pinch means, equal in number to the number of said burners; said burners and the respective associated pinch means being disposed at contiguous sealing stations along the length of said conveyor means whereby the plurality of vials can be sealed simultaneously; rotating means at said sealing means operable, during the sealing operation, to engage and rotate the plurality of vials being simultanously sealed; discharge means positioned adjacent said conveyor means downstream of said sealing means in the direction of movement of said endless belt and operable to remove, from said conveyor means, the filled and sealed vials; and drive means mounted in said frame and including respective control cams for said indexing, feeding, filling, sealing, rotating and discharge means.

2. A machine according to claim 1, in which said frame includes a lower casing supporting said conveyor means, feeding means, discharge means and rotating means, and an upper casing mounted on said lower casing and adjustable for height above said lower casing support surface; control means for the filling and sealing means mounted in said upper casing; said drive means being mounted in said upper casing; and driving elements connecting said drive means to the components supported by said lower casing.

3. A machine according to claim 1, comprising, at a multiple station upstream of the filling means, a plurality of movable needles for scavenging the insides of the vials with an inert gas so as to avoid the presence of a chemically-active atmosphere within the vials at the filling stage.

4. A machine according to claim 1, comprising, for each syringe, and its associated needle, a valve system including an intake tube of resilient material, an outlet tube of resilient material, said intake and outlet tubes being connected to said syringes, respective arms operable to pinch said tube selectively to cut off and to permit flow therethrough, and the single control member connected to said arms and oscillatable to actuate said arms; centering element, equal in number to said plurality of vials, positioned adjacent said filling means to center the valves relative to the respective syringes and needles; said centering elements being projected to detect the presence or absence of a vial of said plurality of vials in centered relation with the associated needle and syringe; and means, including respective resilient couplings associated with each safety device and operatively connected to said valve system, said last-named means, in the absence of a valve centered with respect to the associated needle and syringe, opening the associated intake tube so that no liquid is delivered to the associated needle.

5. A machine according to claim 4, comprising an adjustable cam serving to actuate the said single control member, and means for matching the control member to a part of the profile of the adjustable cam.

6. A machine according to claim 1, in which said rotating means comprises pairs of oscillatory units equal in number to said plurality of vials and each operable to rotate a respective vial; each oscillatory unit including a friction wheel secured to a drive shaft; driving means operable to continuously rotate all of said driving shafts; the respective driving shafts of each pair of oscillatory units, when the associated friction wheels are engaged with a vial, diverging outwardly whereby, as a result of the mutual inclination of said driving shafts, the associated valve is urged into its receptacle during sealing of the vial.

7. A machine according to claim 1, including means supporting said sealing burners for oscillation about a substantially horizontal axis; an arm mounted for oscillation and movable parallel to the oscillation axis of said sealing burners; and a rotary cam having different profiles at successive axial locations therealong; said oscillatable arm being selectively engageable with a respective profile of said rotary cam.

8. A machine according to claim 1, including a plurality of pincers, equal in number to said plurality of vials, positioned adjacent said sealing means; and means operable, subsequent to simultaneous sealing of said plurality of vials, to engage said pincers with the necks of the respective vials to sever the necks from the vials above the seals of the vials.

* * * * *

UNITED STATES PATENT AND TRADEMARK OFFICE

CERTIFICATE OF CORRECTION

PATENT NO. : 3,939,626

DATED : February 17, 1976

INVENTOR(S) : DAVID ALAN HOPKINS

It is certified that error appears in the above-identified patent and that said Letters Patent are hereby corrected as shown below:

Col. 1, line 44, after "Fig. 3", the words "drive key" are deleted

Col. 1, line 61, after "drive" the word --key-- is inserted

Signed and Sealed this

*eighth* Day of *June 1976*

[SEAL]

*Attest:*

RUTH C. MASON
*Attesting Officer*

C. MARSHALL DANN
*Commissioner of Patents and Trademarks*